US006290818B1

(12) United States Patent
Romanski

(10) Patent No.: US 6,290,818 B1
(45) Date of Patent: Sep. 18, 2001

(54) EXPANDED FILM BASE REINFORCEMENT FOR PAPERMAKER'S BELTS

(75) Inventor: Eric R. Romanski, Delmar, NY (US)

(73) Assignee: Albany International Corp., Albany, NY (US)

( * ) Notice: Subject to any disclaimer, the term of this patent is extended or adjusted under 35 U.S.C. 154(b) by 0 days.

(21) Appl. No.: 09/314,727

(22) Filed: May 18, 1999

(51) Int. Cl.[7] ..... D21F 3/02
(52) U.S. Cl. ..... 162/358.4; 162/901; 198/846
(58) Field of Search ..... 162/358.4, 901; 198/846, 847

(56) References Cited

U.S. PATENT DOCUMENTS

| | | | | |
|---|---|---|---|---|
| 4,482,430 | * | 11/1984 | Majaniemi | 162/358.4 |
| 4,744,843 | * | 5/1988 | Lewis | 156/87 |
| 4,832,672 | * | 5/1989 | Bielfeldt | 198/847 X |
| 5,238,537 | * | 8/1993 | Dutt | 162/358.4 |
| 5,697,491 | * | 12/1997 | Alex | 198/846 |
| 5,772,848 | * | 6/1998 | Dutt | 162/358.4 |
| 5,792,323 | | 8/1998 | Grondahl | 162/358.4 |
| 5,837,080 | | 11/1998 | Grondahl | 156/73.4 |
| 5,857,561 | * | 1/1999 | Hardman et al. | 198/846 |
| 5,943,951 | * | 8/1999 | Muellner et al. | 100/37 |
| 6,095,321 | * | 8/2000 | Striegl et al. | 198/847 |

* cited by examiner

*Primary Examiner*—Janice L. Krizek
(74) *Attorney, Agent, or Firm*—Pitney, Hardin, Kipp & Szuch, LLP

(57) ABSTRACT

A resin-coated endless belt for a long nip press has a base which is a polymeric film structure in the form of an endless loop with an inner surface, an outer surface, a transverse direction and a longitudinal direction. The polymeric film structure has a plurality of perforations which may be aligned in one or both of these directions. The polymeric film structure is stretched in the presence of heat to orient the molecular chains in the unperforated intervals between the perforations to provide the structure with tenacity and resistance to further stretching. At least the inner surface of the base (polymeric film structure) is coated with a polymeric resin material, such as polyurethane. The polymeric resin material coats the base and upon curing, forms a mechanical interlock therewith by virtue of the perforations, and renders it impermeable to oil and water. In addition to being useful for a long nip press, the belt may also be used in other papermaking applications, for example, as a calender belt on a calender of the shoe type or on a calender having two or more rolls, or as a transfer belt.

13 Claims, 5 Drawing Sheets

12
20
20
10
18
14
18
16

EXPANDED FILM BASE REINFORCEMENT FOR PAPERMAKER'S BELTS

BACKGROUND OF THE INVENTION

1. Field of the Invention

The present invention relates to mechanisms for extracting water from a web of material, and, more particularly, from a fibrous web being processed into a paper product on a papermaking machine. Specifically, the present invention is an endless belt structure designed for use on a long nip press of the shoe type on a papermaking machine, and for other papermaking and paper-processing applications.

2. Description of the Prior Art

During the papermaking process, a fibrous web of cellulosic fibers is formed on a forming fabric by depositing a fibrous slurry thereon in the forming section of a papermachine. A large amount of water is drained from the slurry in the forming section, after which the newly formed web is conducted to a press section. The press section includes a series of press nips, in which the fibrous web is subjected to compressive forces applied to remove water therefrom. The web finally is conducted to a drying section which includes heated dryer drums around which the web is directed. The heated dryer drums reduce the water content of the web to a desirable level through evaporation to yield a paper product.

Rising energy costs have made it increasingly desirable to remove as much water as possible from the web prior to its entering the dryer section. As the dryer drums are often heated from within by steam, costs associated with steam production can be substantial, especially when a large amount of water needs to be removed from the web.

Traditionally, press sections have included a series of nips formed by pairs of adjacent cylindrical press rolls. In recent years, the use of long press nips of the shoe type has been found to be more advantageous than the use of nips formed by pairs of adjacent press rolls. This is because the longer the time a web can be subjected to pressure in the nip, the more water can be removed there, and, consequently, the less water will remain behind in the web for removal through evaporation in the dryer section.

The present invention relates to long nip presses of the shoe type. In this variety of long nip press, the nip is formed between a cylindrical press roll and an arcuate pressure shoe. The latter has a cylindrically concave surface having a radius of curvature close to that of the cylindrical press roll. When the roll and shoe are brought into close physical proximity to one another, a nip which can be five to ten times longer in the machine direction than one formed between two press rolls is formed. Since the long nip may be five to ten times longer than that in a conventional two-roll press, the so-called dwell time, during which the fibrous web is under pressure in the long nip, may be correspondingly longer that it would be in a two-roll press. The result of this new long nip technology has been a dramatic increase in dewatering of the fibrous web in the long nip when compared to conventional nips on paper machines.

A long nip press of the shoe type requires a special belt, such as that shown in U.S. Pat. No. 5,238,537. This belt is designed to protect the press fabric supporting, carrying and dewatering the fibrous web from the accelerated wear that would result from direct, sliding contact over the stationary pressure shoe. Such a belt must be provided with a smooth, impervious surface that rides, or slides, over the stationary shoe on a lubricating film of oil. The belt moves through the nip at roughly the same speed as the press fabric, thereby subjecting the press fabric to minimal amounts of rubbing against the surface of the belt.

Belts of the variety shown in U.S. Pat. No. 5,238,537 are made by impregnating a woven base fabric, which takes the form of an endless loop, with a synthetic polymeric resin. Preferably, the resin forms a coating of some predetermined thickness on at least the inner surface of the belt, so that the yarns from which the base fabric is woven may be protected from direct contact with the arcuate pressure shoe component of the long nip press. It is specifically this coating which must have a smooth, impervious surface to slide readily over the lubricated shoe and to prevent any of the lubricating oil from penetrating the structure of the belt to contaminate the press fabric, or fabrics, and fibrous web.

The base fabric of the belt shown in U.S. Pat. No. 5,238,537 may be woven from monofilament yarns in a single- or multi-layer weave, and is woven so as to be sufficiently open to allow the impregnating material to totally impregnate the weave. This eliminates the possibility of any voids forming in the final belt. Such voids may allow the lubrication used between the belt and shoe to pass through the belt and contaminate the press fabric or fabrics and fibrous web. The base fabric may be flat-woven, and subsequently seamed into endless form, or woven endless in tubular form.

When the impregnating material is cured to a solid condition, it is primarily bound to the base fabric by a mechanical interlock, wherein the cured impregnating material surrounds the yarns of the base fabric. In addition, there may be some chemical bonding or adhesion between the cured impregnating material and the material of the yarns of the base fabric.

Long nip press belts, such as that shown in U.S. Pat. No. 5,238,537, depending on the size requirements of the long nip presses on which they are installed, have lengths from roughly 13 to 35 feet (approximately 4 to 11 meters), measured longitudinally around their endless-loop forms, and widths from roughly 100 to 450 inches (approximately 250 to 1125 centimeters), measured transversely across those forms.

It will be appreciated that the manufacture of such belts is complicated by the requirement that the base fabric be endless prior to its impregnation with a synthetic polymeric resin.

Nevertheless, belts of this variety have been successfully manufactured for some years. However, lingering problems hamper the manufacturing process.

One of these problems is that it is difficult to remove all of the air from the base fabric during the impregnation and coating process. As implied above, air remaining in the woven structure of the base fabric manifests itself as voids in the final belt product. Such voids may allow the lubrication used between the belt and the arcuate pressure shoe to pass through the belt and contaminate the press fabric or fabrics and fibrous web. As a consequence, it is important, but difficult, to get all air out of the base fabric to achieve its complete impregnation by the synthetic polymeric resin being used.

The present invention provides a solution to this problem in the form of an endless belt structure intended and designed for use as a long nip press (LNP) belt, or as a belt for other papermaking and paper-processing applications, but lacking a traditional woven base structure.

SUMMARY OF THE INVENTION

Accordingly, the present invention is a resin-coated endless belt for a long nip press. The resin-coated endless belt passes through the nip in direct sliding contact with the arcuate pressure shoe, and separates a fibrous web being treated there, and a press fabric or fabrics supporting the fibrous web, from the arcuate pressure shoe, thereby protecting the fibrous web, and the press fabric or fabrics, from damage by direct sliding contact with the arcuate pressure shoe and from contamination by any lubricant on the arcuate pressure shoe. The belt may also be used as a calender belt on a calender of the shoe type or on a calender having two or more rolls.

The resin-coated endless belt comprises a base which is a polymeric film structure in the form of an endless loop having an inner surface, an outer surface, a longitudinal direction and a transverse direction. The polymeric film structure has a plurality of perforations. Preferably, although not necessarily, the perforations are aligned in one of the longitudinal and transverse directions, or are aligned in both of these directions. There are unperforated intervals between the perforations wherein polymeric molecules of the polymeric film structure are oriented in the longitudinal direction or transverse direction, whereby the polymeric film structure is tenacious and resists dimensional changes in the longitudinal and transverse directions. Molecular orientation results from stretching the polymeric sheet structure in the longitudinal direction or transverse direction, or in both of these directions, in the presence of heat.

At least the inner surface of the base has a coating of a polymeric resin material, such as polyurethane. The coating renders the base impermeable to liquids, such as oil and water, and passes through the perforations so that, when the coating is cured, a mechanical interlock between coating and a base is formed. The coating is ground and buffed to provide it with a smooth surface, and the belt with a uniform thickness.

The present invention will now be described in more complete detail with frequent reference being made to the figures, which are listed and identified immediately below.

DETAILED DESCRIPTION OF THE PREFERRED EMBODIMENTS

Figure 1:
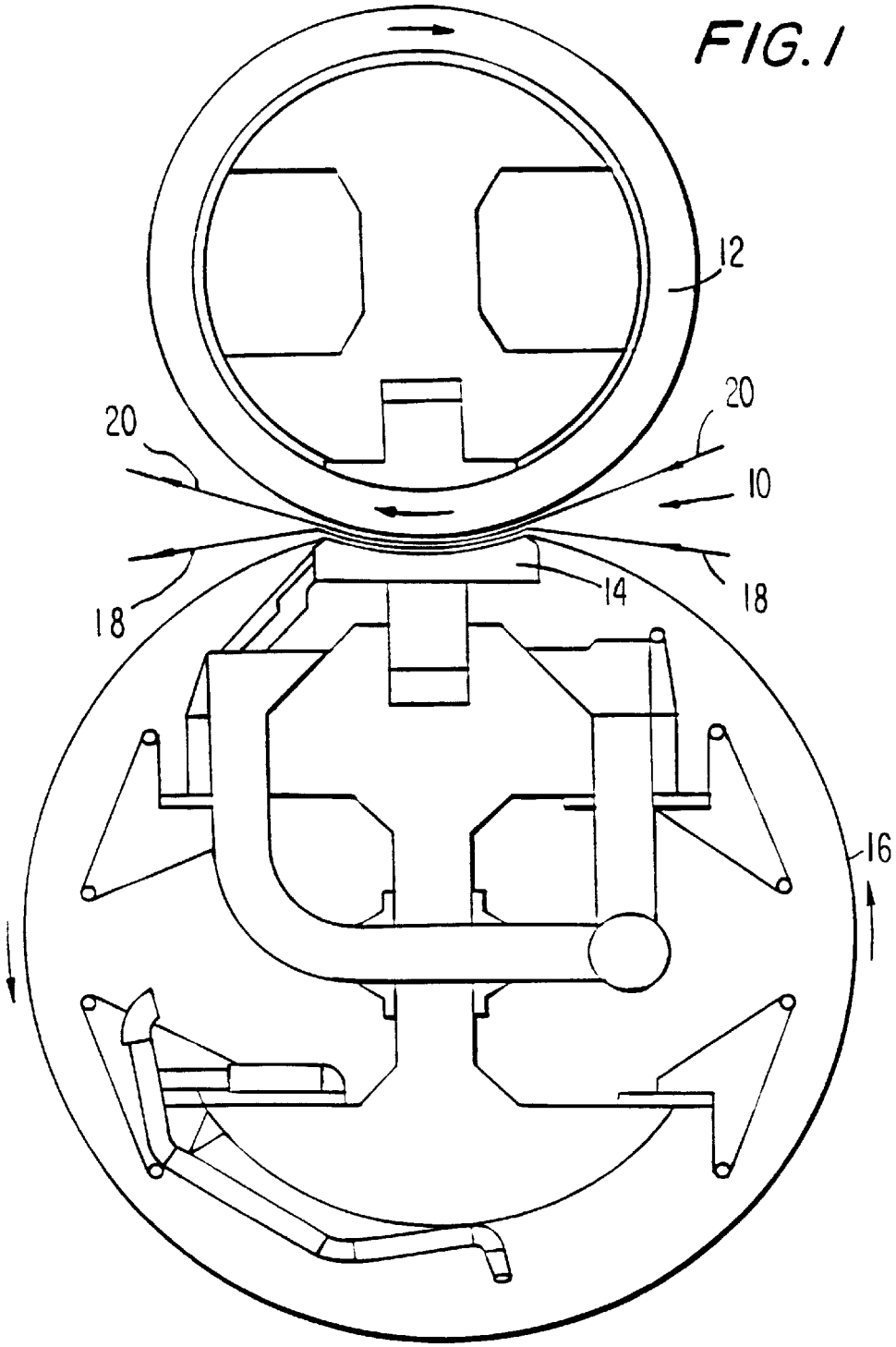
FIG. 1 is a side cross-sectional view of a long nip press.

A long nip press for dewatering a fibrous web being processed into a paper product on a paper machine is shown in a side cross-sectional view in FIG. 1. The press nip 10 is defined by a smooth cylindrical press roll 12 and an arcuate pressure shoe 14. The arcuate pressure shoe 14 has about the same radius of curvature as the cylindrical press roll 12. The distance between the cylindrical press roll 12 and the arcuate pressure shoe 14 may be adjusted by hydraulic means operatively attached to arcuate pressure shoe 14 to control the loading of the nip 10. Smooth cylindrical press roll 12 may be a controlled crown roll matched to the arcuate pressure shoe 14 to obtain a level cross-machine nip profile.

Long nip press belt 16 extends in a closed loop through nip 10, separating cylindrical press roll 12 from arcuate pressure shoe 14. A press fabric 18 and a fibrous web 20 being processed into a paper sheet pass together through nip 10 as indicated by the arrows in FIG. 1. Fibrous web 20 is supported by press fabric 18 and comes into direct contact with smooth cylindrical press roll 12 in nip 10. Fibrous web 20 and press fabric 18 proceed through the nip 10 as indicated by the arrows. Long nip press belt 16, also moving through press nip 10 as indicated by arrows, that is, counterclockwise as depicted in FIG. 1, protects press fabric 18 from direct sliding contact against arcuate pressure shoe 14, and slides thereover on a lubricating film of oil. Long nip press belt 16, accordingly, must be impermeable to oil, so that press fabric 18 and fibrous web 20 will not be contaminated thereby.

Figure 2:
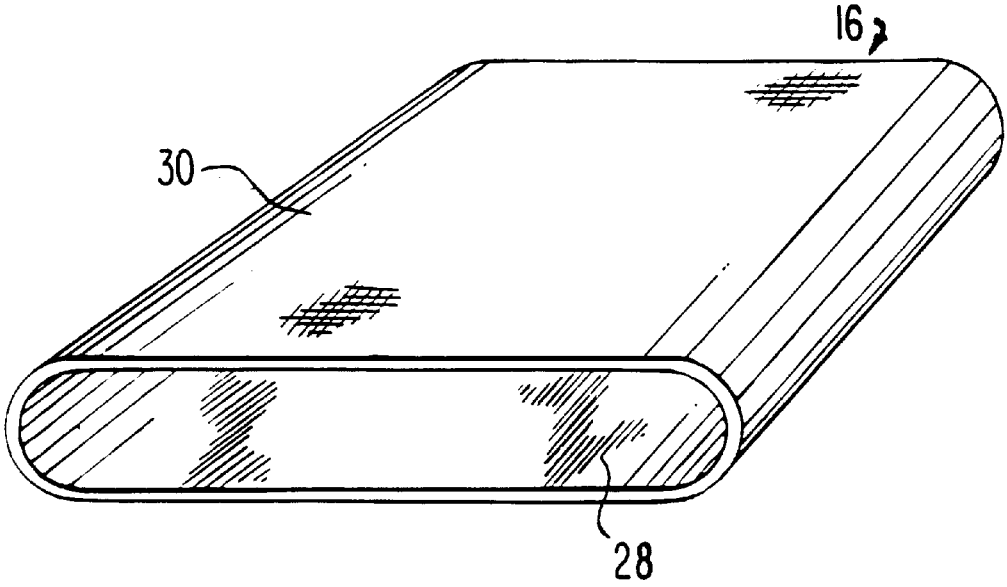
FIG. 2 is a perspective view of a belt of the present invention.

A perspective view of the long nip press belt 16 is provided in FIG. 2. The belt 16 has an inner surface 28 and an outer surface 30.

Figure 3:
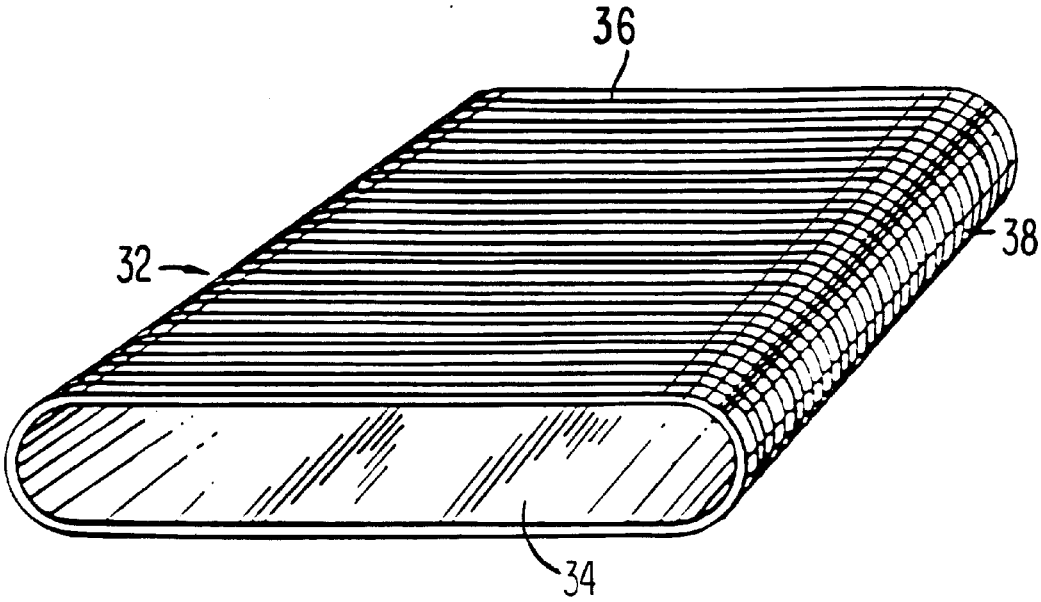
FIG. 3 is a perspective view of an alternate embodiment of the belt.

FIG. 3 is a perspective view of an alternate embodiment of the belt 32. The belt 32 has an inner surface 34 and an outer surface 36. The outer surface 36 is provided with a plurality of grooves 38, for example, in the longitudinal direction around the belt 32 for the temporary storage of water pressed from fibrous web 20 in press nip 10.

Figure 4:
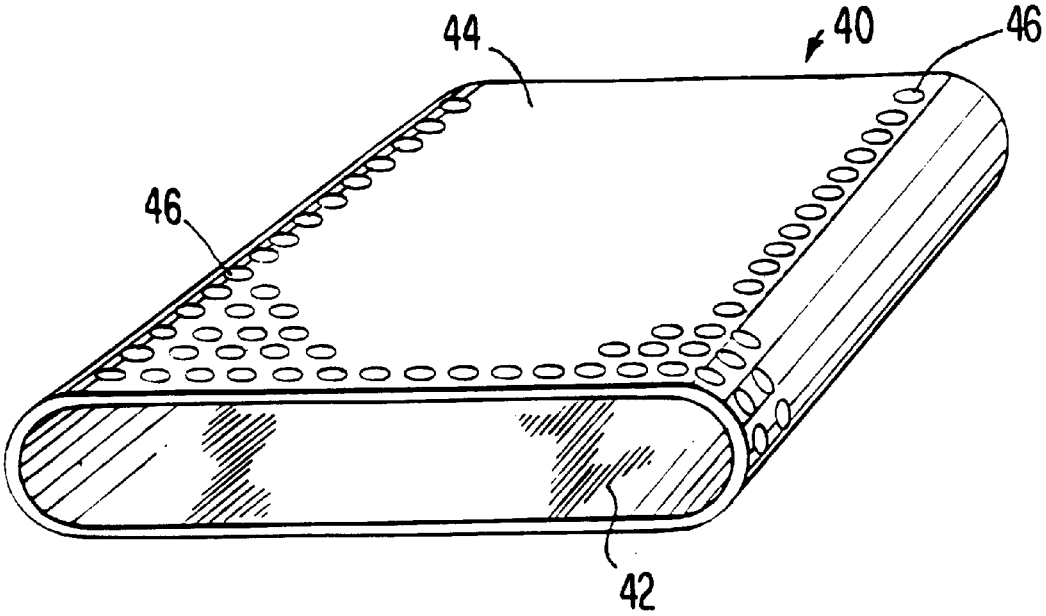
FIG. 4 is a perspective view of another embodiment of the belt.

Alternatively, the outer surface of the belt may be provided with a plurality of blind-drilled holes arranged in some desired geometric pattern for the temporary storage of water. FIG. 4 is a perspective view of such an alternate embodiment of the belt 40. The belt 40 has an inner surface 42 and an outer surface 44. The outer surface 44 is provided with a plurality of blind-drilled holes 46, so called because they do not extend completely through the belt 40.

The long nip press belts 16,32,40 of the present invention include a base which is a polymeric film structure rather than a traditional textile structure. The polymeric film structure is perforated, and is molecularly oriented in the machine or cross-machine direction, or in both of these directions, by being stretched in one or both of these directions in the presence of heat. The heat softens the perforated polymeric film structure and allows its constituent molecular chains to become aligned in the direction or directions in which the stretching is being carried out. The resulting molecular orientation increases the tenacity of the polymeric film structure in the direction or directions in which the stretching occurred.

Figure 5:
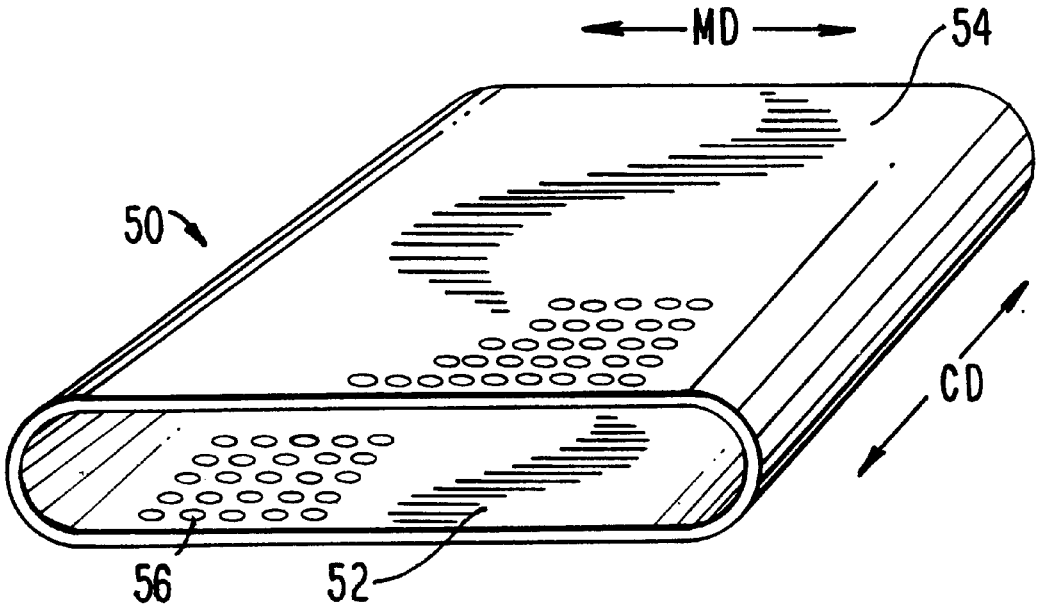
FIG. 5 is a perspective view of the base for the belt of the present invention.

FIG. 5 is a perspective view of the base 50 for the belts of the present invention. The base 50 is in the form of an endless loop and has an inner surface 52 and an outer surface 54. The longitudinal, or machine, direction is indicated as "MD" in FIG. 5, while the transverse, or cross-machine direction is indicated as "CD".

Preferably, the polymeric film structure of base 50 takes the form of a tubular sleeve, which is first perforated and is then stretched in the presence of heat either longitudinally or transversely, or both longitudinally and transversely, to the dimensions of the belt to be manufactured. Alternatively, the polymeric film structure of base 50 may take the form of a flat sheet, which is first perforated, is then stretched in the presence of heat in its lengthwise or widthwise direction, or in both its lengthwise and widthwise directions, and is finally joined into the form of an endless loop having the dimensions of the belt to be manufactured.

The joining of the flat sheet into the form of an endless loop may be accomplished by overlapping the two ends of the flat sheet with one another, and by using heat and pressure to join the two ends to one another. The combination of heat and pressure additionally ensures that the area of the joint will have the same thickness as the rest of the flat sheet.

Alternatively, the two ends of the flat sheet may be butted against one another, and joined together by chemical or ultrasonic means to place the flat sheet into the form of an endless loop.

The base 50 has a plurality of perforations 56 which pass completely therethrough, and which are shown on both the inner surface 52 and the outer surface 54 in FIG. 5. For the sake of clarity, only some perforations 56 are shown; it should be understood that the entire base 50 is perforated in the illustrated manner.

Figure 6:
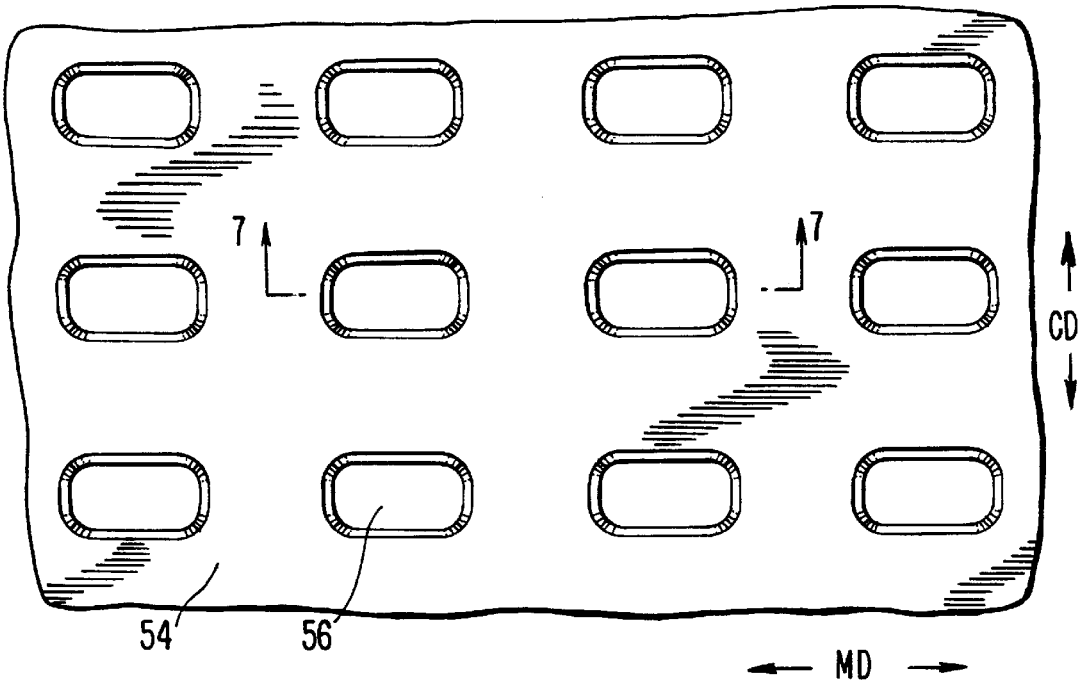
FIG. 6 is a plan view of a portion of the outer surface of the base.

FIG. 6 is a plan view of a portion of the outer surface 54 of the base 50. Perforations 56 are shown as being of roughly rectangular shape with rounded corners. In general, the shape of the perforations depends upon their initial shape, as well as the amounts by which the polymeric film structure has been stretched in its machine and cross-machine directions. In any event, the perforations 56 always have some roundedness to them and lack sharp corners as a result of the stretching process.

Preferably, although not necessarily, the perforations 56 initially align in the direction or directions in which the polymeric film structure is to be stretched to produce base 50. That is to say, if the polymeric film structure is to be stretched in what will ultimately be the machine direction of the base 50 being produced, the perforations 56 preferably align in that direction, so that the unperforated intervals between rows of perforations in FIG. 6 will acquire the tenacity to serve as the equivalent of machine-direction yarns. By the same token, if the polymeric film structure is to be stretched in what will ultimately be the cross-machine direction of the base 50 being produced, the perforations 56 preferably align in that direction, so that the unperforated intervals between columns of perforations 56 in FIG. 6 will acquire the tenacity to serve as the equivalent of cross-machine-direction yarns. Where the polymeric film structure is to be stretched in both directions, the perforations 56 preferably align in both directions, as suggested by FIG. 6.

Figure 7:
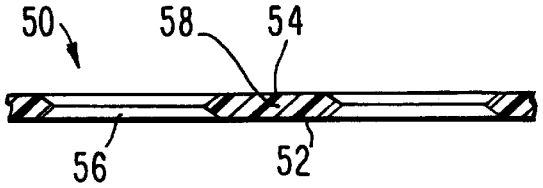
FIG. 7 is a cross-sectional view taken as indicated by line 7—7 in FIG. 6.

FIG. 7 is a cross-sectional view taken as indicated by line 7—7 in FIG. 6. The polymeric film structure is stretched so that base 50 has a thickness between 5 mil (0.005 inch; 0.127 mm) and 200 mil (0.200 inch; 5.1 mm) at its thickest point between neighboring perforations 56 after stretching, such as at point 58.

The base 50, as previously noted, is a polymeric film structure. It is extruded from a polymeric resin material, such as polyamide or polyester, although it should be understood that the polymeric film structure may be extruded from any thermoplastic polymeric resin material. Once extruded in either flat or tubular form, it is perforated and then stretched in the presence of heat in its widthwise or lengthwise direction, or in both its widthwise and lengthwise directions. If it is in flat form, it is then joined into the form of an endless loop.

Following its manufacture, the base 50 is coated with a polymeric resin material using techniques well known in the art. The polymeric resin material is applied to at least one surface of the base 50, that surface being the one which will ultimately be the inner surface of the belt. As the inner surface slides across the lubricated arcuate pressure shoe 14, the coating of polymeric resin material protects the base 50 from such sliding contact and the wear by abrasion that would otherwise result. The polymeric resin material also renders the belt impermeable to oil and water, and passes through the perforations 56 in the base 50. Upon curing, the polymeric resin material forms a mechanical interlock with the base 50 as a result of passing through the perforations 56. To some extent, a chemical bond may also be formed between the polymeric resin material and the base 50.

The polymeric resin material may be polyurethane, and, if so, is preferably a 100% solids composition thereof to avoid the formation of bubbles during the curing process through which the polymeric resin material proceeds following its application onto the base 50. After curing, the coating of polymeric resin material is ground and buffed to provide the belt with a smooth surface and a uniform thickness.

It will be recognized that, where only one surface of the base 50 is coated with the polymeric resin material, the other surface of the base 50 may end up being uneven, as nubs of the polymeric resin material are likely to be formed where the material passes through perforations 56 from the surface being coated. For this reason, it is preferable that both surfaces of the base 50 be coated with a polymeric resin material. Following the curing of the polymeric resin material, both the inner surface and the outer surface of the belt may be ground and buffed to provide the belt with smooth surfaces and a uniform thickness. Finally, the outer surface may be provided, by cutting, scoring, graving or drilling, with a plurality of grooves, for example, in the longitudinal direction around the belt, or blind-drilled holes for the temporary storage of water pressed from fibrous web 20 in the press nip 10.

It will also be recognized that modifications to the above would be obvious to anyone of ordinary skill in the art without departing from the scope of the claims appended hereinbelow.

What is claimed is:

1. A resin-coated endless belt for a long nip press or calender, or for other papermaking and paper-processing applications, said resin-coated endless belt comprising:

a base, said base being a polymeric film structure in the form of an endless loop with an inner surface, an outer surface, a longitudinal direction and a transverse direction, said polymeric film structure having a plurality of perforations and having unperforated intervals between said perforations wherein polymeric molecules of said polymeric film structure are oriented in one of said longitudinal and transverse directions, whereby said polymeric film structure is tenacious and resists dimensional changes in said one of said longitudinal and transverse directions; and a coating of a polymeric resin material on at least said inner surface of said base, said coating rendering said base impermeable to liquids and passing through said perforations whereby a mechanical interlock between said base and said coating is formed, said coating being smooth and providing said belt with a uniform thickness.

2. A belt as claimed in claim 1 wherein said polymeric molecules of said polymeric film structure are oriented in one of said longitudinal and transverse directions in some of said unperforated intervals and in the other of said longitudinal and transverse directions in others of said unperforated intervals, whereby said polymeric film structure is tenacious and resists dimensional changes in both of said longitudinal and transverse directions.

3. A belt as claimed in claim 1 wherein said perforations are aligned in one of said longitudinal and transverse directions, and wherein said polymeric molecules of said polymeric film structure are oriented in said one of said longitudinal and transverse directions in at least some of said unperforated intervals.

4. A belt as claimed in claim 1 wherein said perforations are aligned in both of said longitudinal and transverse directions, and wherein said polymeric molecules of said polymeric film structure are oriented in said longitudinal direction in some of said unperforated intervals and in said transverse direction in others of said unperforated intervals.

5. A belt as claimed in claim 1 wherein said coating of a polymeric resin material is on both said inner surface and said outer surface of said base.

6. A belt as claimed in claim 1 wherein said polymeric resin material is polyurethane.

7. A belt as claimed in claim 1 wherein said polymeric film structure is extruded from a thermoplastic polymeric resin material.

8. A belt as claimed in claim 1 wherein said polymeric film structure is extruded from a polymeric resin material selected from the group consisting of polyamide and polyester.

9. A belt as claimed in claim 1 wherein said unperforated intervals between said perforations have a maximum thickness in the range between 5 mil and 200 mil.

10. A belt as claimed in claim 1 wherein said coating on said inner surface of said base is ground and buffed to give said belt a uniform thickness and desired surface characteristics.

11. A belt as claimed in claim 5 wherein said coating on both said inner and outer surfaces is ground and buffed to give said belt a uniform thickness and desired surface characteristics.

12. A belt as claimed in claim 5 wherein said coating on said outer surface of said belt includes a plurality of grooves, said coating, apart from said grooves, providing said belt with a uniform thickness.

13. A belt as claimed in claim 5 wherein said coating on said outer surface of said belt includes a plurality of blind-drilled holes, said coating, apart from said blind-drilled holes, providing said belt with a uniform thickness.

* * * * *